US005568235A

United States Patent [19]

Amarakoon

[11] Patent Number: 5,568,235

[45] Date of Patent: Oct. 22, 1996

[54] INDUCTION HEATED INTERMEDIATE TRANSFER MEMBER

[75] Inventor: Kiri B. Amarakoon, Pittsford, N.Y.

[73] Assignee: Xerox Corporation, Stamford, Conn.

[21] Appl. No.: 493,833

[22] Filed: Jun. 22, 1995

[51] Int. Cl.[6] ..... G03G 15/10; G03G 15/16

[52] U.S. Cl. ..... 355/256; 219/619; 355/279; 430/126

[58] Field of Search ..... 355/256, 279; 430/126; 219/619

[56] References Cited

U.S. PATENT DOCUMENTS

| | | | |
|---|---|---|---|
| 3,392,667 | 7/1968 | Cassel et al. | 101/170 |
| 3,399,611 | 9/1968 | Lusher | 430/44 |
| 3,955,530 | 5/1976 | Knechtel | 118/60 |
| 3,957,367 | 5/1976 | Goel | 355/281 |
| 4,348,098 | 9/1982 | Koizumi | 355/274 |
| 4,515,460 | 5/1985 | Knechtel | 355/327 |
| 4,588,279 | 5/1986 | Fukuchi et al. | 355/271 |
| 4,708,460 | 11/1987 | Langdon | 430/126 X |
| 4,935,788 | 6/1990 | Fantuzzo et al. | 355/326 R |
| 5,089,856 | 2/1992 | Landa et al. | 355/279 |
| 5,204,722 | 4/1993 | Thompson et al. | 355/279 |
| 5,254,424 | 10/1993 | Felder | 430/112 |
| 5,283,409 | 2/1994 | Brendel et al. | 219/619 |
| 5,352,558 | 10/1994 | Simms et al. | 430/125 |
| 5,355,201 | 10/1994 | Hwang | 355/256 |

FOREIGN PATENT DOCUMENTS 4-250482 9/1992 Japan .

*Primary Examiner*—Arthur T. Grimley
*Assistant Examiner*—Sophia S. Chen
*Attorney, Agent, or Firm*—John M. Kelly

[57] ABSTRACT

Intermediate transfer assemblies, and printing machines and methods which use such assemblies, which inductively dry liquid images on an intermediate transfer member. The assemblies include an intermediate transfer member that receives a liquid image which is comprised of a liquid carrier and toner particles. An induction coil assembly comprised of a ferromagnetic core wrapped with a plurality of turns of a conductive element and which is spaced apart from the intermediate transfer member creates alternating magnetic flux lines which create eddy currents in a conductive heating element, causing that element to heat. If the conductive heating element is part of the induction coil assembly heat is radiated onto the liquid image. If the conductive heating element is part of the intermediate transfer member the heat is conducted to the liquid image. In either case the heat dries the liquid image by causing the liquid carrier to evaporate.

18 Claims, 3 Drawing Sheets

INDUCTION HEATED INTERMEDIATE TRANSFER MEMBER

FIELD OF THE INVENTION

This invention relates to electrophotographic printing machines, specifically those machines which use an intermediate transfer member and which use liquid developers.

BACKGROUND OF THE INVENTION

Electrophotographic printing machines such as copiers and printers have become common place. In such machines a photoconductive surface is charged to a substantially uniform potential. That surface is then exposed to light to record an electrostatic latent image which corresponds to the information to be marked onto a substrate. Thereafter, a developer comprised of charged powder toner particles is transported into contact with the electrostatic latent image. Those toner particles are attracted onto the latent image to form a toner powder image. That powder image is then transferred from the photoconductive surface onto a substrate and then fused (permanently affixed) to the substrate using heat and pressure.

The foregoing generally describes a typical black and white electrophotographic printing machine. Electrophotographic printing can also produce color images by repeating the above process for each color of toner that is used to make the color image. For example, the charged photoconductive surface may be exposed to a light image which represents a first color, say black. The resultant electrostatic latent image can then be developed with black toner particles to produce a black image which is subsequently transferred to a substrate. The process is then be repeated for a second color, say yellow, then a third color, say magenta, and finally a fourth color, say cyan. Beneficially each color toner image is transferred to the substrate in superimposed registration so as to produce the desired composite toner powder image on the substrate.

The color printing process described above superimposes the various color toner powder images directly onto a substrate. Another color printing process uses an intermediate transfer belt. In such systems successive toner powder images are transferred in superimposed registration from the photoconductor onto the intermediate transfer belt. Only after the composite toner powder image is formed on the intermediate transfer belt is the composite toner powder image transferred to the substrate and fused.

Developing materials are usually comprised of not only toner particles but also carrier granules. In practice, the toner particles triboelectrically adhere to the carrier granules until the toner powder particles are attracted to the latent image on the photoconductor. An alternative to such powder developing materials are liquid developing materials.

Liquid developers, also referred to as liquid inks, use a liquid carrier into which the toner particles are dispersed. When developing with liquid developers both the toner particles and the liquid carrier are advanced into contact with the electrostatic latent image. Of course after the liquid developer is deposited on a receiving surface that surface is wet with the liquid carrier. Since it is usually undesirable to deposit liquid onto most substrates, systems which use liquid developers generally use an intermediate transfer member which receives and drys the liquid image before transferring the image onto a substrate.

Heating the intermediate transfer member would be advantageous since it would tend to drive off the liquid carrier and leave behind a coagulated toner image. However, it is important that the intermediate transfer member is not overheated and that it is cool before the next liquid image is received. In the prior art the requirements of receiving the liquid developer on a cool surface and driving off the liquid carrier without damaging either the intermediate transfer member or the photoconductive surface while achieving high quality images from a fast printing machine were difficult to achieve simultaneously. Thus, inventive apparatus and methods which enable fast localized heating of intermediate transfer members and/or of liquid carriers while having a relatively cool intermediate transfer member where toner images are received from a photoconductive surface would be beneficial.

Various approaches have been devised to produce multicolor color copies. The following disclosures may be useful references:

U.S. Pat. No. 3,392,667
Patentee: Cassel et al.
Issued: Jul. 16, 1968

U.S. Pat. No. 3,399,611
Patentee: Lusher
Issued: Sep. 3, 1968

U.S. Pat. No. 3,955,530
Patentee: Knechtel
Issued: May 11, 1976

U.S. Pat. No. 3,957,367
Patentee: Goel
Issued: May 18, 1976

U.S. Pat. No. 4,348,098
Patentee: Koizumi
Issued: Sep. 7, 1982

U.S. Pat. No. 4,515,460
Patentee: Knechtel
Issued: May 7, 1985

U.S. Pat. No. 4,588,279
Patentee: Fukuchi et al.
Issued: May 13, 1986

U.S. Pat. No. 4,935,788
Patentee: Fantuzzo et al
Issued Jun. 19, 1990

U.S. Pat. No. 5,254,424
Patentee: Felder
Issued: Oct. 19, 1993

U.S. Pat. No. 5,352,558
Patentee: Simms et al
Issued: Oct. 4, 1994

U.S. Pat. No. 5,355,201
Patentee: Hwang
Issued: Oct. 11, 1994

The disclosures of the above-identified patents may be briefly summarized as follows:

U.S. Pat. No. 3,392,667 discloses a plurality of print cylinders having gravure engravings on their peripheries. Powder feed hoppers having rotating brushes apply powder to the print cylinders. The powder images from the print cylinders are transferred to an offset roller in superimposed registration with one another. The resultant powder image is then transferred from the offset roller to paper or sheeting.

U.S. Pat. No. 3,399,611 describes four image transfer stations disposed about the periphery of a rotatable cylindrical metal drum. Each image transfer station is basically the same and includes a photoconductive drum charged by a charging wire and then rotated into alignment with an image exposure station to record a latent image thereon. Powder particles are then cascaded across the latent image to develop it. The powder image is then transferred to the surface of the metal drum. The powder particles are of different colors. The completed powder image is transferred from the metal drum to an article to be decorated.

U.S. Pat. No. 3,955,530 discloses a color image forming electrophotographic printing machine. Different color developers are used to develop the latent images recorded on the photoconductive drum. Each developed image is sequentially transferred to an intermediate transfer drum. A cleaning blade is used to clean the photoconductive drum between developing different color developers. The complete image is transferred from the intermediate drum to a copy sheet.

U.S. Pat. No. 3,957,367 describes a color electrophotographic printing machine in which successive different color toner powder images are transferred from a photoconductive drum to an intermediate roller, in superimposed registration with one another, to an intermediary roller. The multilayered toner powder image is fused on the intermediary roller and transferred to the copy sheet.

U.S. Pat. No. 4,348,098 discloses an electrophotographic copying apparatus which uses a transfix system. In a transfix system, the developed image is transferred from the photoconductive member to an intermediate roller. The intermediate roller defines a nip with a fixing roller through which the copy sheet passes. The developed image is then transferred from the intermediate roller to a copy sheet. The developing unit of the copying apparatus may either be a dry or wet type.

U.S. Pat. No. 4,515,460 describes a color electrophotographic copying machine in which four developer units develop four latent images recorded on a photoconductive drum with different color toner particles. The different color toner powder images are transferred to an endless belt in superimposed registration with one another. The resultant toner powder image is then transferred from the belt to a copy sheet.

U.S. Pat. No. 4,588,279 discloses an intermediate transfer member that has a dry toner image transferred thereto from the surface of a toner image forming member. The toner image is then transferred from the transfer member to a recording paper.

U.S. Pat. No. 4,935,788 discloses a multicolor printing system that uses liquid developing and an intermediate member.

U.S. Pat. No. 5,254,424 discloses a liquid developer material which contains toner particles formed from a urethane modified polyester.

U.S. Pat. No. 5,352,558 discloses a liquid developer system which uses an absorbing belt.

U.S. Pat. No. 5,355,201 discloses an apparatus for developing an electrostatic latent image with liquid toner.

SUMMARY OF THE INVENTION

The present invention provides for intermediate transfer assemblies that inductively heat liquid images which are comprised of a liquid carrier and toner particles. A first embodiment intermediate transfer assembly includes an intermediate transfer member that receives a liquid image. That embodiment further includes an induction coil assembly which is spaced from the intermediate transfer member by a small gap. The induction coil assembly is comprised of a ferromagnetic core wrapped by a plurality of windings of a conductor and of a conductive heating layer disposed between the gap and the windings. When an alternating current passes through the windings alternating magnetic flux lines induce eddy currents within the conductive heating layer which cause the heating layer to heat up. Heat radiates from the conductive heating assembly across the gap and onto both the liquid image and the intermediate transfer member, causing the liquid carrier to evaporate. Beneficially the intermediate transfer member includes an outer dielectric layer, a core,and a thermally insulating layer disposed between the dielectric layer and the core. A second embodiment intermediate transfer assembly includes an intermediate transfer member which receives liquid images. That intermediate transfer member is comprised of a core, an outer dielectric layer, and a conductive heating layer disposed between the core and the outer dielectric layer. The second embodiment intermediate transfer assembly further includes an induction coil assembly which is spaced from the intermediate transfer member by a small gap. That induction coil assembly is comprised of a ferromagnetic core and a plurality of windings of a conductive element. When an alternating current passes through the windings alternating magnetic flux lines induce eddy currents within the intermediate transfer member's conductive heating layer. Those eddy currents cause that conductive heating layer to heat. Heat then conducts from the conductive heating layer to the dielectric layer and to the liquid image. That heat causes the liquid carrier of the liquid image to evaporate. Beneficially the intermediate transfer member includes an electrically and thermally insulating layer disposed between the conductive heating layer and the core.

The present invention also provides for electrophotographic printing machines which produce marks on a substrate. Such machines include a charge retentive surface capable of being charged and of being subsequently discharged by exposure to radiant energy so as to produce a latent image comprised of greater and lesser electrostatic potentials. Those machines further include a charging station for charging the charge retentive surface; an exposure station for exposing the charge retentive surface to radiant energy so as to produce a latent image on the charge retentive surface; and a developing station for transferring liquid development material onto the latent image so as to produce an image on the charge retentive surface. Printing machines according to the present invention further include an intermediate transfer member for receiving the liquid image and a heat generating induction coil assembly spaced apart from the intermediate transfer member by a small gap. The induction coil assembly induces eddy currents which cause a conductive layer to heat up. The conductive layer then transfers heat to the liquid development material. The conductive layer may be part of the induction coil assembly, in which case heat is radiated from the conductive layer onto the liquid image, or the conductive layer may be part of the intermediate transfer member, in which case heat is conducted from the conductive layer to the liquid image.

The present invention also provides for a method of drying a liquid image on an intermediate transfer member.

That method includes the steps of depositing a liquid image on the intermediate transfer member, and then inductively heating a conductive layer located adjacent the liquid image. Heat from the conductive layer causes the liquid carrier in the liquid image to evaporate.

BRIEF DESCRIPTION OF THE DRAWINGS

Other aspects of the present invention will become apparent as the following description proceeds and upon reference to the drawings, in which.

Note that in the drawings that like numbers designate like elements.

DETAILED DESCRIPTION OF THE PREFERRED EMBODIMENTS

Figure 1:
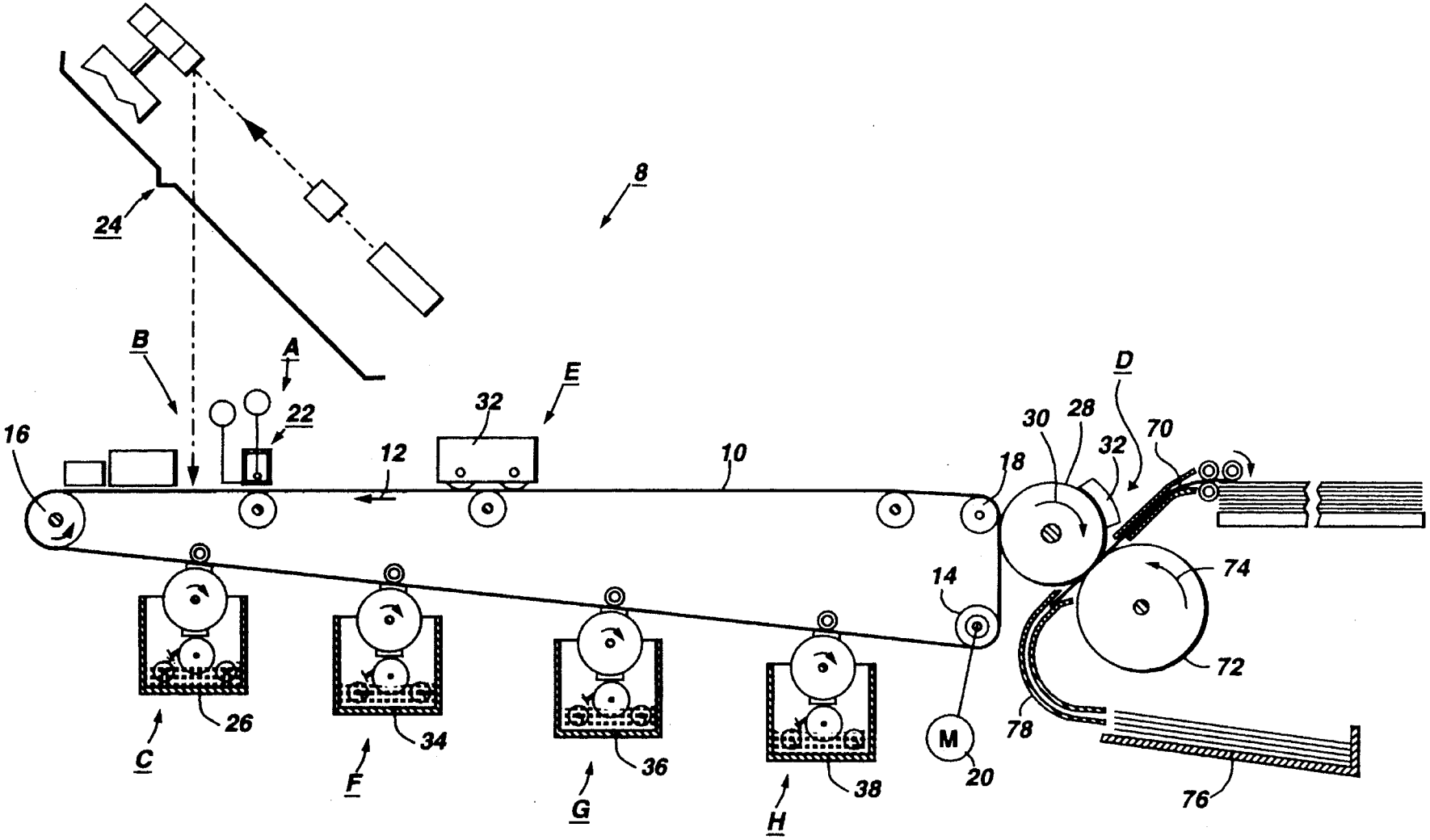
FIG. 1 is a schematic illustration of an electrophotographic printing machine which incorporates the principles of the present invention.

FIG. 1 illustrates an electrophotographic printing machine 8 that includes various components which are used to print a color image on a substrate. Although the principles of the present invention are well suited for use in color electrophotographic copiers, they are is also well suited for use in other printing devices in which a liquid is to be heated. Therefore it should be understood that the present invention is not limited to the particular embodiment illustrated in FIG. 1 or to the particular application shown therein.

The printing machine 8 includes a charge retentive surface in the form of an Active Matrix (AMAT) photoreceptor belt 10 which travels sequentially through the various process stations in the direction indicated by the arrow 12. Photoreceptor belt travel is brought about by mounting the photoreceptor belt about a drive roller 14 and two tension rollers, the rollers 16 and 18, and then rotating the drive roller 14 via a drive motor 20.

As the photoreceptor belt moves each part of it passes through each of the subsequently described process stations. For convenience, a single section of the photoreceptor belt, referred to as the image area, is identified. The image area is that part of the photoreceptor belt which is to receive the liquid images which after being fused to a substrate produces the final image. While the photoreceptor belt may have numerous image areas, since each image area is processed in the same way a description of the processing of one image area suffices to explain the operation of the printing machine.

As the photoreceptor belt 10 moves, the image area passes through a charging station A. At charging station A a corona generating scorotron 22 charges the image area to a relatively high and substantially uniform potential, for example about −500 volts. While the image area is described as being negatively charged, it could be positively charged if the charge levels and polarities of the other relevant sections of the copier are appropriately changed.

After passing through the charging station A the now charged image area passes to an exposure station B. At exposure station B the charged image area is exposed to the output of a laser based output scanning device 24 which illuminates the image area with a light representation of a first color image, say black. That light representation discharges some parts of the image area so as to create an electrostatic latent image.

After passing through the exposure station B, the now exposed image area passes through a first development station C. The first development station C advances negatively charged liquid development material 26, which is comprised of black toner particles and a liquid carrier, onto the image area. The liquid development material is attracted to the less negative sections of the image area and repelled by the more negative sections. The result is a first liquid image on the image area.

After passing through the first development station C, the now developed image area passes to an intermediate transfer station D. The intermediate transfer station D includes an intermediate transfer drum 28 (alternatively a belt could be used) which is located near the photoconductor belt 10. The intermediate transfer drum rotates synchronously with the photoconductor belt in the direction 30. The liquid image is transferred from the photoconductor belt to the intermediate transfer drum by positively charging the intermediate transfer drum such that the negatively charged liquid image is attracted onto the intermediate transfer drum. A pretransfer charging station (which is not shown) may be used to assist transfer.

The intermediate transfer station D also includes an inductive heating assembly 32 which indirectly heats the liquid image so as to evaporate the liquid carrier such that toner particles coagulate on the intermediate transfer drum. That heating is accomplished by passing an alternating current through an induction coil which is located near a conductive heating layer. The alternating current in the induction coil creates eddy currents in the conductive heating layer, causing it to heat up. That heat is then transferred to the liquid image as is subsequently explained. In response, the liquid carrier evaporates and the toner coagulates on the intermediate transfer drum.

Figure 2:
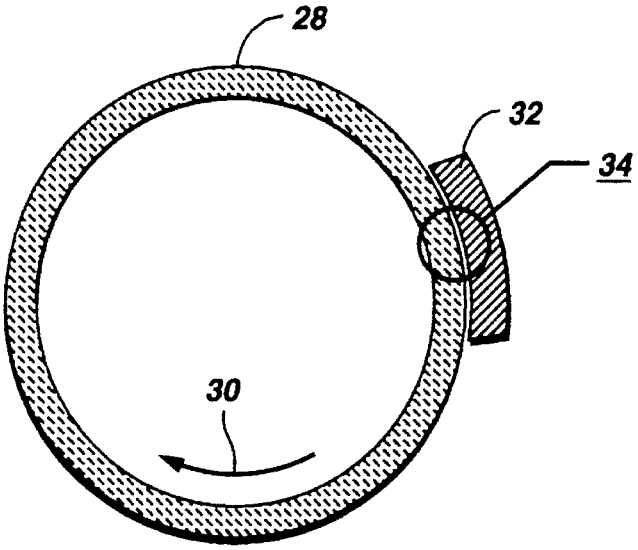
FIG. 2 shows an isolation view of the transfer: station D of FIG. 1.

FIG. 2 illustrates the general positioning of the inductive coil assembly 32 relative to the intermediate transfer drum 28. In practice the intermediate transfer drum is comprised of a hollow aluminum core with one or more outer layers which are subsequently described. As shown, the inductive coil assembly 32 is separated from the intermediate transfer drum 28 by a small gap. By "small" it is meant that the inductive coil assembly is near enough to the intermediate transfer drum that heat generated by eddy currents can dry the liquid carrier yet far enough from the the intermediate transfer drum that the inductive coil assembly does not interfere with the liquid image. A physical separation of about 0.5 millimeters is beneficial.

Figure 3:
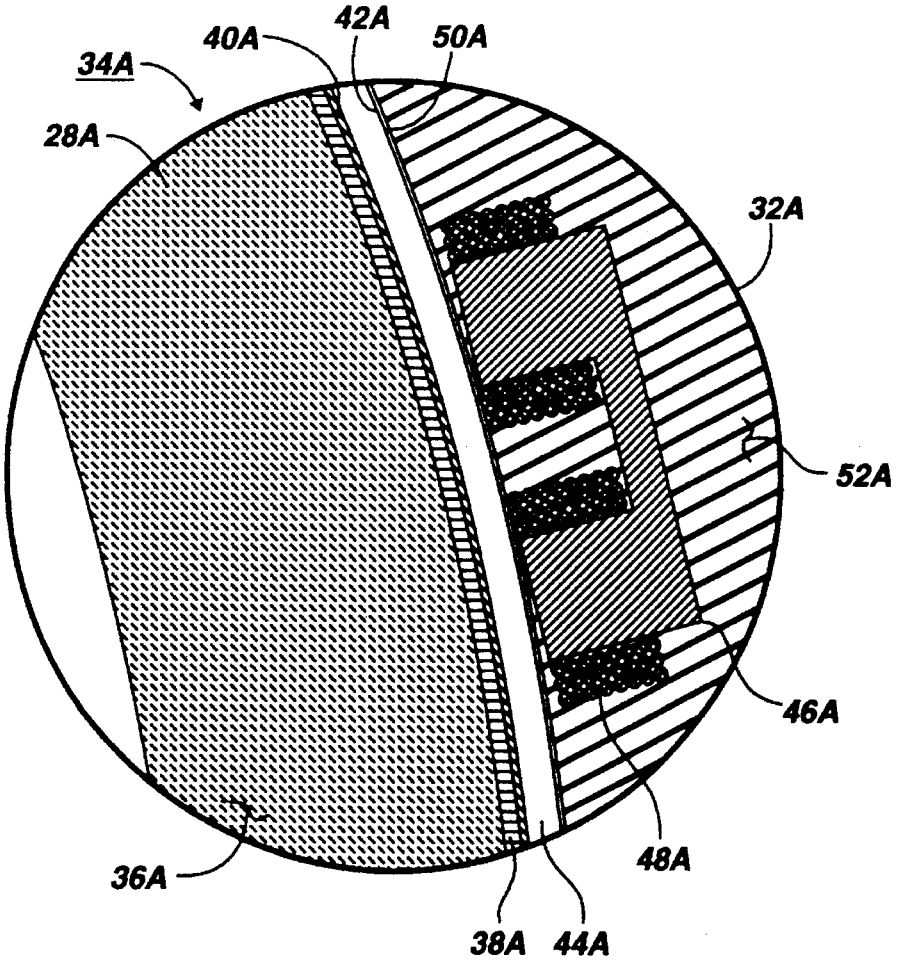
FIG. 3 shows a schematic depiction of a first embodiment of the highlighted area 34 of FIG. 2.

FIG. 3 illustrates one useful embodiment of the shaded area 34 in FIG. 2. Since the shaded area 34 can be take several forms, many of which share common elements, the elements of the particular implementation illustrated in FIG. 3 are designated with a following A. The intermediate transfer drum 28A in FIG. 3 is comprised of an aluminum core 36A which is surrounded by a thermally insulating outer dielectric layer 38A. FIG. 3 also shows a thin layer 40A of a liquid development material on the outer dielectric layer 38A. The bottom surface 42A of an inductive coil assembly 32A is spaced from the outer dielectric layer 38A by a small gap 44A. Still referring to FIG. 3, the inductive coil assembly 32A includes a ferromagnetic core 46A which is wrapped by a plurality of turns 48A of a wire. Below the core 46A is an electrically conductive layer 50A (which has a bottom surface 42A) and over the core and the windings is a nonconductive potting material 52A.

Still referring to FIG. 3, in operation an alternating current is applied between the ends of the wire which makes up the windings 48A. The alternating current induces eddy currents in the conductive layer 50A which cause that layer to heat up. The conductive layer then radiates heat onto both the layer 40A of the liquid development material and the dielectric layer 38A. Since the dielectric layer is a thermal insulator it blocks heat flow to the aluminum core 36A. The heat applied to the layer 40A causes the liquid carrier of the liquid image to be driven off, which causes the liquid development materials toner particles to coagulate.

Figure 4:
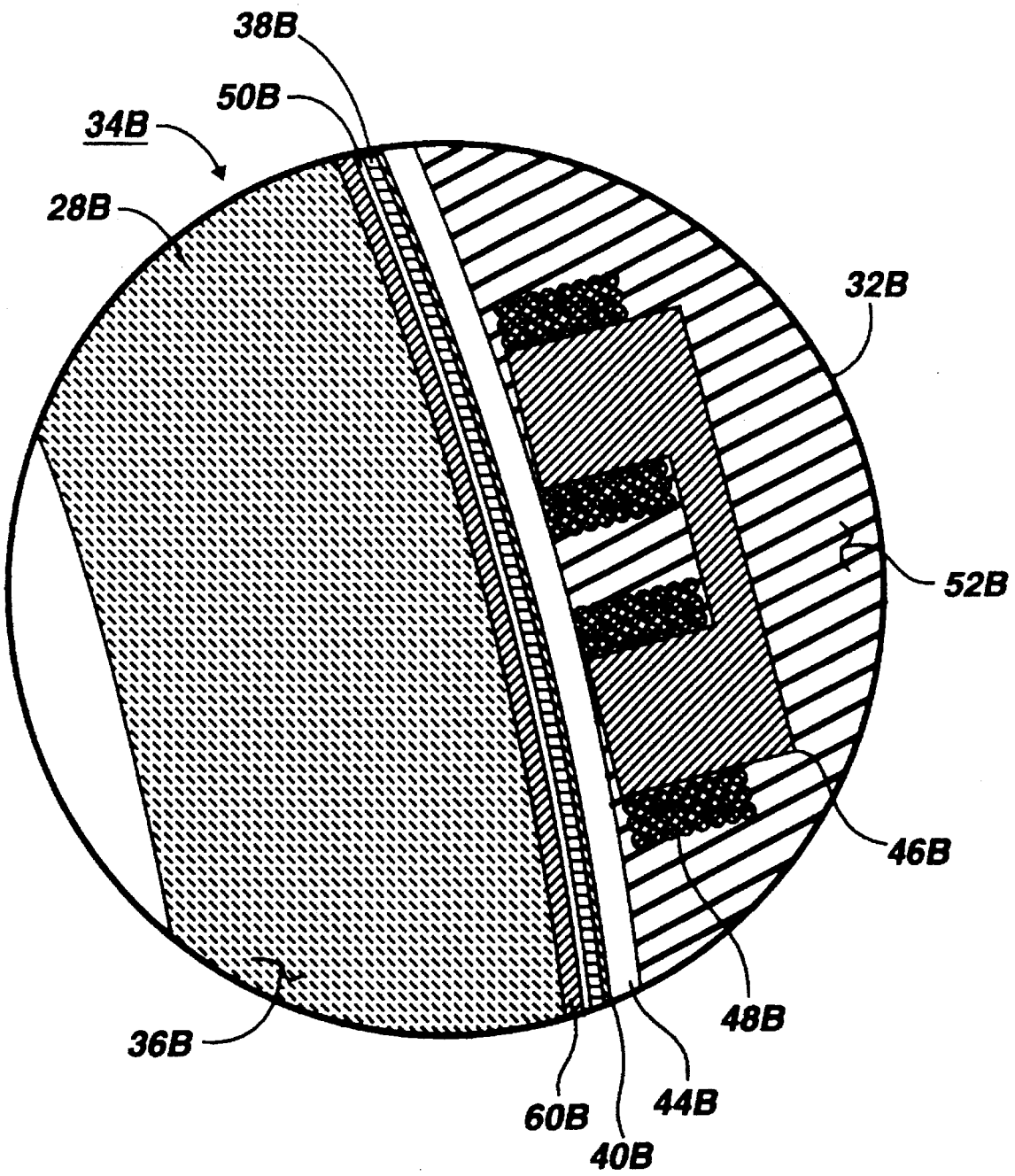
FIG. 4 shows a schematic depiction of a second embodiment of the highlighted area 34 of FIG. 2.

FIG. 4 illustrates another useful embodiment of the shaded area 34 in FIG. 2. For convenience the elements of FIG. 4 are designated with a following B. The intermediate transfer drum 28B is comprised of an aluminum core 36B which is surrounded by an electrically and thermally insulating layer 60B. Over the insulating layer 60B is an electrically conductive heating layer 50B. Finally, over the heating layer 50B is a dielectric layer 38B. FIG. 4 also shows a thin layer 40B of liquid development material on the dielectric layer 38B. Spaced by a small gap 44B from the dielectric layer 38B is an inductive coil assembly 32B. The inductive coil assembly includes a ferromagnetic core 46B which is wrapped by a plurality of turns 48B of a wire. Over the core and the windings is a nonconductive potting material 52B.

Still referring to FIG. 4, in operation an alternating current is applied between the ends of the wire which makes up the windings 48B. The alternating current induces an alternating magnetic field which includes eddy currents in the conductive layer 50B. Those eddy currents cause the conductive layer to heat up. Heat then conducts from the conductive layer 50B to the dielectric layer 38B, causing the dielectric layer to heat up. That heat causes the liquid carrier of the liquid development material to evaporate, which causes the toner particles to coagulate. The insulating layer 60B thermally and electrically isolates the aluminum core 36B from the conductive layer 50B.

Now referring back to FIG. 1, after the first liquid image is transferred to the intermediate transfer drum 28 the image area passes to a cleaning station E. The cleaning station E removes any residual development material from the photoconductor belt 10 using a cleaning brush contained in a housing.

After passing through the cleaning station E the image area repeats the charge-expose-develop-transfer sequence for a second color of toner material (say yellow). First, charging station A recharges the image area and exposure station B illuminates the recharged image area with a light representation of a second color image (yellow) to create a second electrostatic latent image. The image area then advances to a second development station F which deposits a second negatively charged liquid development material 34 which is comprised of yellow toner particles and a liquid carrier onto the image area. The image area and its second liquid image then advance to the transfer station D where the second liquid image is transferred onto the intermediate transfer drum 28.

As previously noted, the intermediate transfer drum 28 rotates synchronously with the movement of the photoconductor belt. That synchronization is such that the transferred second liquid image (and the subsequently described third and fourth color images) is registered with the now dried first liquid image. By registered it is meant that the images add so as to create an accurate visual representation of the desired image.

The second liquid image is then dried by the transfer station D (in the manner which was previously described) and the image area is again cleaned by the cleaning station E. The charge-expose-develop-transfer/dry-clean sequence is then repeated for a third color (say magenta) of liquid development material 36 using development station G, and for a fourth color (say cyan) of liquid development material 38 using development station H.

After all four liquid images have been transferred onto the intermediate transfer drum the composite toner image is the fused onto a substrate 70. It is to be understood that the support sheet is advanced to the intermediate transfer drum by a conventional sheet feeding apparatus which is not shown. The fusing process involves disposing the substrate between the intermediate transfer drum 28 and a heated pressure roller 72 which rotates in the direction 74. When the substrate passes between the fuser roller and the intermediate transfer drum and the pressure roller the toner powder is permanently affixed to the substrate. After fusing a chute 78 guides the substrate into a catch tray 76 or removal by an operator.

It is believed that the foregoing general description is sufficient for the purposes of illustrating the general operation of color printing machines which incorporate the principles of the present invention. While the foregoing was directed to a copier it will be appreciated that the principles of the present invention may also be applied to other printing machines, specifically including printers. Furthermore, it is to be understood that the figures and the above description are exemplary only. Others will recognize numerous modifications and adaptations of the illustrated embodiments which will remain within the principles of the present invention. Therefore, the present invention is to be limited only by the appended claims.

What is claimed:

1. An intermediate transfer assembly comprising:

an intermediate transfer member for receiving an image comprised of a liquid carrier and toner particles;

a heat generating induction coil assembly spaced apart from said intermediate transfer member by a gap, said induction coil assembly comprising a ferromagnetic core wrapped with a plurality of windings of a conductive element; and a conductive heating layer;

wherein an alternating current passing through said plurality of windings creates alternating magnetic flux lines that induce eddy currents within said conductive heating layer which cause the conductive heating layer to heat up and to heat said image, and wherein said conductive heating layer is disposed between said gap and said plurality of windings.

2. The intermediate transfer assembly according to claim 1, wherein said conductive heating layer radiates heat onto said intermediate transfer member.

3. The intermediate transfer assembly according to claim 1, wherein said intermediate transfer member includes an outer dielectric layer.

4. The intermediate transfer assembly according to claim 3, wherein said intermediate transfer member includes an electrically and thermally isolating layer below said outer dielectric layer.

5. The intermediate transfer assembly according to claim 4, wherein said conductive heating layer is disposed between said isolating layer and said outer dielectric layer.

6. The intermediate transfer assembly according to claim 5, wherein said conductive heating layer conducts heat to said image.

7. The intermediate transfer assembly according to claim 3, wherein said conductive heating layer is disposed below said dielectric layer.

8. The intermediate transfer assembly according to claim 7, wherein said conductive heating layer conducts heat to said image.

9. The intermediate transfer assembly according to claim 1, wherein said intermediate transfer member comprises a hollow aluminum tube.

10. A printing machine of the type having a developed image on a charge retentive surface, wherein the improvement comprises:

an intermediate transfer member disposed adjacent said charge retentive surface and receiving a developed image comprised of a liquid carrier and toner particles;

a heat generating induction coil assembly spaced apart from said intermediate transfer member by a gap, said induction coil assembly comprising a ferromagnetic core wound with a plurality of windings of a conductive element; and a conductive heating layer;

wherein an alternating current passing through said plurality of windings creates alternating magnetic flux lines that induce eddy currents within said conductive heating layer which cause the conductive heating layer to heat up and to heat said image, and wherein said conductive heating layer is disposed between said gap and said plurality of windings.

11. The printing machine according to claim 10, wherein said conductive heating layer radiates heat onto said intermediate transfer member.

12. The printing machine according to claim 10, wherein said intermediate transfer member includes an outer dielectric layer.

13. The printing machine according to claim 12, wherein said intermediate transfer member includes an electrically and thermally isolating layer below said outer dielectric layer.

14. The printing machine according to claim 13, wherein said conductive heating layer is disposed between said isolating layer and said outer dielectric layer.

15. The printing machine according to claim 14, wherein said conductive heating layer conducts heat to said image.

16. The printing machine according to claim 12, wherein said conductive heating layer is disposed below said dielectric layer.

17. The printing machine according to claim 16, wherein said conductive heating layer conducts heat to said image.

18. The printing machine according to claim 10, wherein said intermediate transfer member comprises a hollow aluminum tube.

* * * * *